US005502743A

United States Patent [19]

Conochie et al.

[11] Patent Number: 5,502,743

[45] Date of Patent: Mar. 26, 1996

[54] HIGH TEMPERATURE FURNACE

[75] Inventors: David S. Conochie, Hawthorn East; Shane M. Neecowen, Fairfield; Rory A. D. Poulter, Altona; Gregory McLeod, Westlake, all of Australia

[73] Assignees: Comalco Aluminium Limited, Victoria; Commonwealth Scientific and Industrial Research Organisation, Campbell, both of Australia

[21] Appl. No.: 136,834

[22] Filed: Oct. 18, 1993

Related U.S. Application Data

[63] Continuation-in-part of Ser. No. 793,375, Jan. 2, 1992, abandoned.

[30] Foreign Application Priority Data

Mar. 5, 1990 [AU] Australia ..... PJ8931

[51] Int. Cl.[6] ..... H05B 6/22

[52] U.S. Cl. ..... 373/151; 373/157; 373/159

[58] Field of Search ..... 373/109, 111, 373/117–120, 138–139, 144, 150–151, 153, 155, 157, 27, 159, 160, 161, 163, 146; 65/13, 374.13; 219/672, 676, 677; 49/634

[56] References Cited

U.S. PATENT DOCUMENTS

| | | | |
|---|---|---|---|
| 1,655,983 | 1/1928 | Brace | 373/159 |
| 3,696,223 | 10/1972 | Metcalf et al. | 219/634 |

FOREIGN PATENT DOCUMENTS

| | | |
|---|---|---|
| 891263 | 3/1962 | United Kingdom . |
| 1430382 | 3/1976 | United Kingdom . |
| 2082879 | 3/1982 | United Kingdom . |

*Primary Examiner*—Tu Hoang
*Attorney, Agent, or Firm*—Nikaido, Marmelstein, Murray & Oram

[57] ABSTRACT

A furnace configuration is disclosed in which the furnace is inductively heated by external insulated coils and a susceptor is placed within the charge of reactants away from the outer surfaces of the charge. Consequently, heat is transferred to the charge and the process approaches completion before the insulation is subjected to high temperatures.

38 Claims, 12 Drawing Sheets

Fig. 3(a)
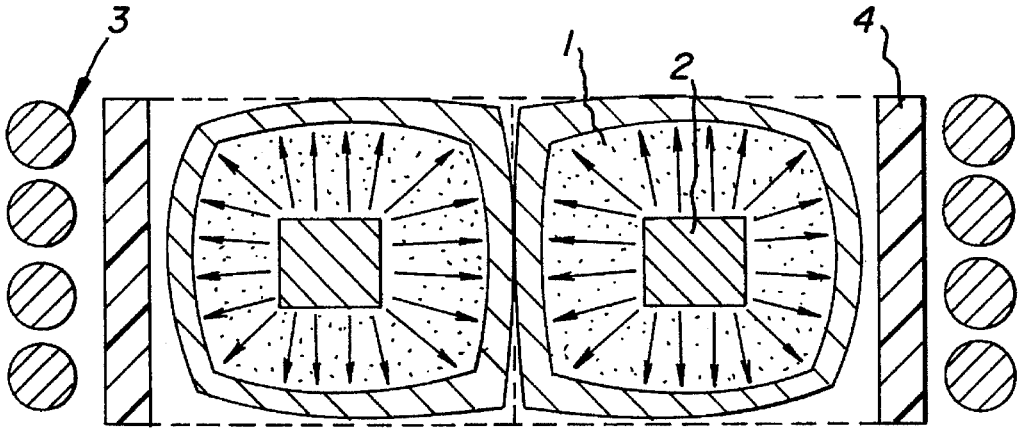
Fig. 3(b)
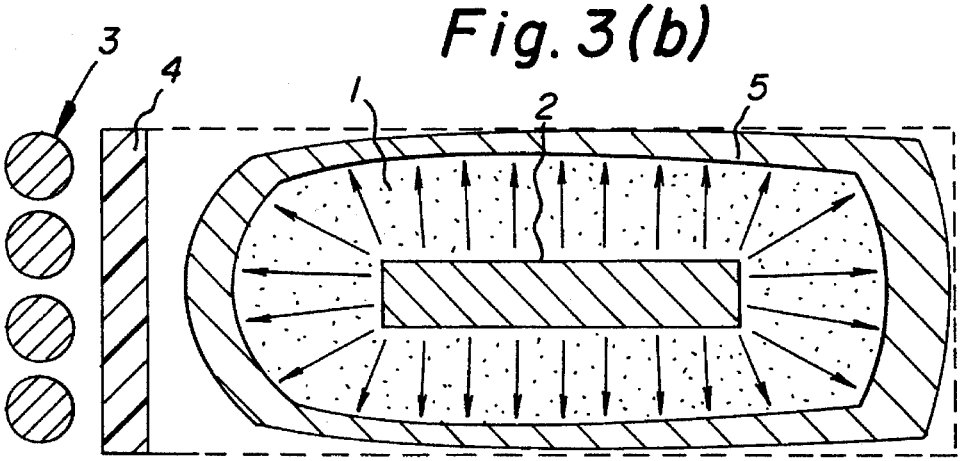
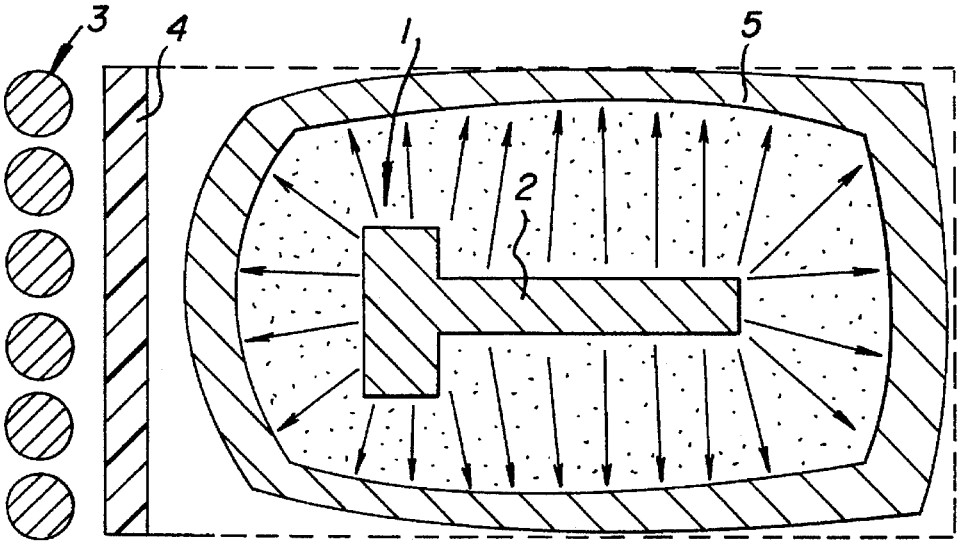
Fig. 3(c)

Fig. 11a
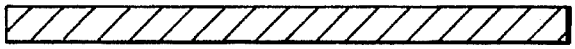
Fig. 11b
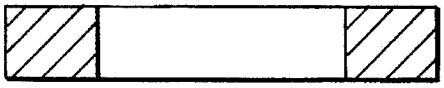
Fig. 11c
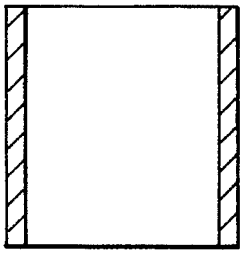
Fig. 11d
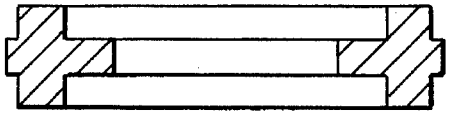
Fig. 11e
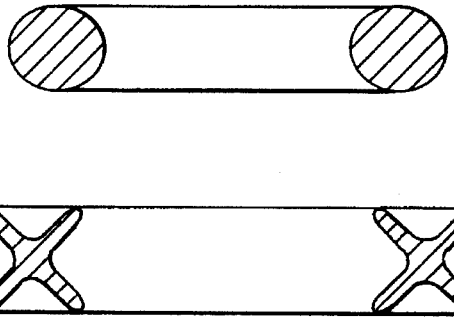
Fig. 11f
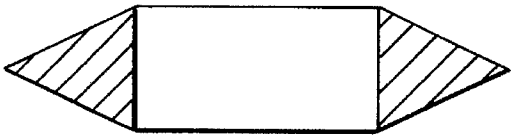
Fig. 11g
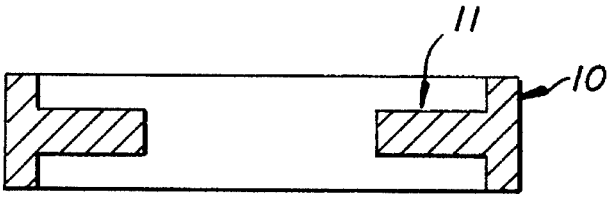
Fig. 11h

HIGH TEMPERATURE FURNACE

This application is a continuation-in-part of Ser. No. 07/793,375 filed on Jan. 2, 1992, now abandoned.

BACKGROUND OF THE INVENTION

This invention relates to a furnace configuration for high temperature processes which may require high thermal energies such as melting and/or chemical reaction. The invention also relates to a method for the preparation of a product by heating a charge of reactants to a high temperature.

Many high temperature processes are not suited to a scale-up in production from laboratory bench to industrial scale because of their heat transfer requirements and in such cases scale up results in a marked deterioration in furnace performance.

Processes which are limited in their scale-up because of heat transfer requirements are generally those in which the charged material or products formed have a high thermal resistance, undergo endothermic reactions, one component of the reaction is a significantly volatile species at the temperature of the reaction. Upon scale-up, such heat transfer limited processes suffer from the problems of greatly increased reaction times, increased specific energy consumption or incomplete reaction leading to non-uniform product.

Examples of reactions which exhibit such properties are the carbothermic reduction of transition metal or rare earth oxides to transition metal or rare earth borides, carbides and nitrides, production of silicon carbide and boron carbide, silicon smelting, remelting of oxidised metal fines, and ferroalloy production.

Furnaces usually used for production of transition metal borides, carbides and nitrides and similar refractory materials include arc furnaces, resistance furnaces, rotary furnaces, pusher furnaces, induction heated crucible or induction heated shaft furnaces.

Rotary kilns, and pusher furnaces suffer from a low occupancy of charge in the hot zone, so for a given scale, the surface area and heat losses are high. Rotary kilns which can operate under reducing conditions are expensive to engineer for high temperature operation and are limited in their ability to be scaled up.

Induction heated crucibles and shafts suffer from rapid loss of thermal efficiency and long reaction times as soon as the scale exceeds about 3 kg batch.

Various attempts have been made to improve the performance and scale-up of processes limited by heat transfer requirements.

A) Choosing a reactor design which reduces the heat transfer distance.

Methods to reduce the heat transfer distance include the use of multiple small reactors or crucibles in a pusher furnace, the use of a long slender reactor in which one or two dimensions are small, and tumbling the charge as in a rotary kiln. These attempts suffer from the disadvantages of increased surface area to volume ratio and hence high heat losses, and an increase in the size of the furnace hot zone with no corresponding increase in production capacity or efficiency.

B) Driving the heat transfer with high temperature source such as an arc or a plasma.

Arc and plasma furnaces have been designed to place a high intensity heat source at the core of the furnace, and temperatures in the zone of the arc at all stages of reaction are in excess of 2000°–2500° C. Whilst high heat transfer rates can be achieved with the high arc temperature, any components which are volatile may consequentially be lost to the gas phase before they have an opportunity to react to completion. In addition, such furnaces are restricted in their ability to achieve reaction in a narrow temperature range which may be regarded as optimum from a thermodynamic/processing point of view and arc furnaces usually produce a sintered product.

Use of three electrodes enables some reduction of the heat transfer distance, in the horizontal plane, but there is little scope to increase the reaction zone in the vertical direction as this greatly increases heat transfer distances.

Arc furnaces usually use for example, the staffing materials $TiO_2/B_4C/C$ for synthesis of $TiB_2$ because the boron is present in a less volatile form than $B_2O_3$ at reaction temperature, and the bulk density of the charge is higher. The high temperature of the arc can then be used to thermally drive the endothermic reaction. The synthesis of $B_4C$ also made in an arc furnace, however suffers from the same constraints and costs of $B_2O_3$ volatility.

$B_2O_3$ can be used in the arc furnace charge as a boron source but losses of $B_2O_3$ to the gas phase are high and consequently $B_2O_3$ is the major cost in raw materials.

C) Using a heat source which generates heat within the charge.

Microwave and resistance heating, and reaction synthesis techniques would at first glance, appear to be the ideal solution to heat transfer limited processes.

Microwave techniques can be used to achieve through heating and high temperatures. However, the containment of microwave energy, the measurement of temperature, the selection of microwave transparent refractories, the low efficiency of conversion of electrical energy to microwaves (50– 70%), and the limitation of magnetron sizes to 10–40 KW each, all represent significant problems in engineering microwave based processes. A more fundamental limitation which may occur in a process which undergoes chemical reaction is the uneven power distribution between reactants and products which can lead to thermal runaway in the product.

Resistance techniques have traditionally been used in the Atcheson type furnace, but the technique suffers from hot spots and the cost of high current engineering.

The use of self-propagating high temperature synthesis techniques (SHS) has attracted a lot of attention for synthesis of refractory hard materials, because reactions are chosen so that the reaction is exothermic, instead of strongly endothermic. The method however transfers the problems and costs of endothermic processes to the synthesis of the reactants used. For example Ti and B metal powders can be used to synthesise $TiB_2$ but the costs of the powders are high. This is justified only when a) there is no other viable method, b) there are advantages in obtaining high value-added sintered or fused product, or c) convenience for small quantities.

In another variation, the reductant for SHS may be Al or Mg powder, which in addition to the above mentioned limitations, leaves an oxide in the product for later separation.

The price of transition metal or rare earth borides on the world market is high because a furnace configuration which is capable of operating at a reasonable thermal efficiency on a large scale and produce quality product with low boron loss has not previously been used.

SUMMARY OF THE INVENTION

It is an object of the invention to provide a simple, durable high temperature furnace configuration which allows increased production with a high temperature process, especially those processes whose production is limited by heat transfer characteristics and/or the volatility of one or more of its components.

It is a further object of the invention to provide a method for preparing a product that results in a high yield of product and minimises the amount of unreacted reactants remaining in the reaction furnace.

To achieve the objectives it has been found that by placing the heat source within the charge, the heat transfer distance is reduced. The heat source is therefore away from the insulation hot face and high heat losses are avoided, particularly when driving the reactors at higher power densities. In addition higher power can be used with given process constraints because heat flow is both inward and outward.

In accordance with the invention, there is provided a high temperature furnace configuration for use in preparing products by heating a charge of reactants to a high temperature wherein said reactants undergo a reaction to form said products, the charge or products having a low thermal conductivity, the reaction having a high heat of reaction, the furnace configuration comprising;

an outer shell which enables control of gaseous atmosphere inside the furnace during operation, an induction means adjacent the outer shell, a thermal insulating layer insulating the induction means, a charge receiving space within the insulating layer for receiving the charge, the charge being placed in the charge receiving space such that the charge occupies a volume defined between an inner limit of the charge and an outer limit of the charge, the inner limit of the charge being defined as a part of the charge which is farthest from said insulating layer, induction susceptor means positioned within the charge receiving space, said induction susceptor means having a coupling portion that provides a continuous conductive path for induced current within said susceptor means, the induction susceptor means being positioned within the charge in the charge receiving space such that a cross-sectional center of area of the susceptor means in a radial direction is within the range of about 30%– 90% of a radial distance from the inner limit of the charge to the outer limit of the charge, wherein a progressing zone front for substantially completely reacted product emanates away from the induction susceptor means and the charge located in a volume of the charge receiving space defined between the inner limit of the charge and an inner part of the induction susceptor means has substantially reacted when the progressing zone front reaches and external limit of the charge.

The positioning of the susceptor means is important to the invention because if the susceptor means is placed closer to the center, fusion of product occurs at the core and the time for the progressing zone front for substantially completely reacted product to reach the outside increases. In some cases as a consequence of the high energy input for the processes suitable for the furnace configuration of the invention, a steady state may be achieved before the progressing zone front reaches the outside of the charge and so the yield of product is reduced.

If the susceptor means is placed closer to the outside, additional time is required for the reaction zone front to reach the core. During this time, heat losses are high and insulation damage occurs. The external limits of the charge are the internal surfaces of the furnace which are insulated and include the sides and ends of the furnace.

The furnace may be provided with spacers to maintain the position of the susceptor means within the furnace.

The body of the charge may be a solid cylindrical or annular cylindrical configuration. When the body of the charge is annular the inner limits of the charge becomes the inner surface of the furnace confining the annular charge. However, it is also possible that furnaces which have non-cylindrical external surfaces may also be used in accordance with the invention. In such cases the external surface would be an averaging of the distances from the core.

The electromagnetic induction means preferably comprises one or more heating coils operating at a medium frequency which may be water-cooled and may have at least one layer of thermal and electrical insulation separating them from the charge.

The induction susceptor means may be of any configuration but preferably consists of at least one annular shaped susceptor of suitable material such as graphite or alternatively the susceptor may be a hollow cylinder.

The susceptor means is preferably shaped as a solid of revolution of its radial cross-sectional configuration.

The radial cross-sectional configuration of the susceptor may be a star, rectilinear, oval, circular, tinned or any desired specific shape. The cross-sectional area will depend on factors such as mechanical strength, electrical characteristics and the maximum allowable surface temperature of the ring for any given power rating.

For a susceptor of constant density, the center of area of a radial cross-section is the centroid of the radial cross-section.

The power rating of the susceptor relates to the power transferred per unit surface area of susceptor and is within the range of 2 to 200 $kW/m^2$ and preferably 30 to 60 $kW/m^2$.

If the susceptor means is a ring, toroid or hollow cylinder it preferably is co-axial with the charge.

Preferably, the susceptor means comprises at least two susceptors positioned in the charge such that a reaction front progressing from the susceptor reaches the center or inner limits of the charge or the progressing reaction front of an adjacent processing front prior to reaching the external limits of the charge. Preferably the progressing reaction front reaches the center or inner limits of charge at about the same time as it reaches the progressing reaction front of an adjacent processing front.

During the reaction, the reaction zone front spreads in every direction from the surface of the susceptor means. As discussed earlier to avoid unnecessary heat losses and insulation damage, it is preferable that the processing is completed when the progressing zone front reaches the external surface of the charge. To maximise yield and quality, when two or more susceptors are used, it is preferable that the susceptors are placed so that the reaction of reactants is complete when the progressing zone front reaches the external surfaces of the charge.

Graphite is the preferred susceptor material, but many structural forms of carbon can be used as well as refractory hard material (RHM) and composites thereof.

A refractory hard material is a carbide, boride or nitride of a group comprising transitional and rare earth elements in groups IV, V and VI of the period table, boron and silicon, e.g. titanium diboride.

The RHM must be able to act as a susceptor at or up to the reaction temperature and beyond.

As would be appreciated the requirements of the susceptor are that it is electrically conductive so that a current can be induced and thermal energy generated by resistive losses and the material is capable of withstanding the reaction temperature and chemical environment.

While the furnace configuration is particularly suited to a low thermally conducting charge and/or product and the charge can be in physical forms such as powder pellets, briquettes and granules.

In accordance with another aspect of the invention there is provided a high temperature furnace configuration having an outer shell which enables control of gaseous atmosphere inside the furnace during operation, an induction means adjacent the outer shell, an insulating layer insulating the induction means from the outer shell, a charge receiving space within the insulating layer for receiving a charge and an induction susceptor means positioned within the charge receiving space, the susceptor means comprising a coupling portion for inductively coupling to said induction means said coupling portion providing a continuous conductive path for induced current within said susceptor means, and a conducting portion extending radially from said coupling portion to conduct heat generated in said coupling portion into a charge within the charge receiving space.

As the susceptor represents the path of least thermal resistance, the conducting portion of the susceptor means allows heat to be more uniformly delivered to the reactants. This is particularly useful when the furnace for the reaction is scaled-up so that heat can be delivered to charge in the extremities of the furnace without increasing the temperature of the product nearer the susceptor beyond acceptable limits.

The configuration of the present invention changes the sequence of insulation/susceptor/charge typically used in an induction heated furnace to insulation/charge/susceptor/charge. This enables the susceptor temperature to be raised to drive the heat transfer to the charge without also driving the heat losses to the walls. Also the charge actually provides additional thermal resistance to the losses to the surroundings. Energy efficiency is then better than external heating and is better than that achieved with through heating. The positioning of the susceptor in the charge allows a more uniform transfer of heat to the charge, which enables a high temperature process to be scaled up to produce a high purity product at a high yield.

The configuration of the invention enables minimization of maximum heat transfer distance which enables maximization of reactor scale at a given maximum heat transfer distance.

In a further aspect, the invention provides a method for the preparation of a product by heating a charge of reactants to a high temperature wherein the reactants undergo a reaction to form the product, one or both of the reactants and the product having a low thermal conductivity, the reaction having a high heat of reaction, which process comprises —providing a furnace configuration comprising an outer shell which enables control of gaseous atmosphere inside the furnace during operation, an induction means adjacent the outer shell, a thermal insulating layer insulating the induction means, a charge receiving space within the insulating layer for receiving the charge, the charge being placed in the charge receiving space such that the charge occupies a volume defined between an inner limit of the charge and an outer limit of the charge, the inner limit of the charge being defined as a part of the charge which is farthest from the insulating layer, induction susceptor means positioned within the charge receiving space, the induction susceptor means having a coupling portion that provides a continuous conductive path for induced current within the susceptor means, —energising the induction means to thereby heat the susceptor means and to cause the charge located adjacent the susceptor means to increase in temperature and to undergo the reaction to produce the product and to form a progressing zone front for substantially completely-reacted product, wherein the progressing zone front emanates away from the susceptor means as time elapses, —wherein the susceptor means is positioned within the charge in the charge receiving space such that a cross-sectional center of area of the susceptor means in a radial direction is within about 30–90% of a radial distance from the inner limit of the charge to the outer limit of the charge and the charge of reactants located between the inner limit of the charge and an inner part of said susceptor means has substantially reacted when the progressing zone front reaches an external limit of the charge.

The foregoing and other features objects advantages of the present invention will become more apparent from the following description of the preferred embodiments in which:

BRIEF DESCRIPTION OF THE DRAWING FIGURES

FIG. 3 is a schematic view illustrating the progression of the processing zone from the susceptor.

Figure 5A:
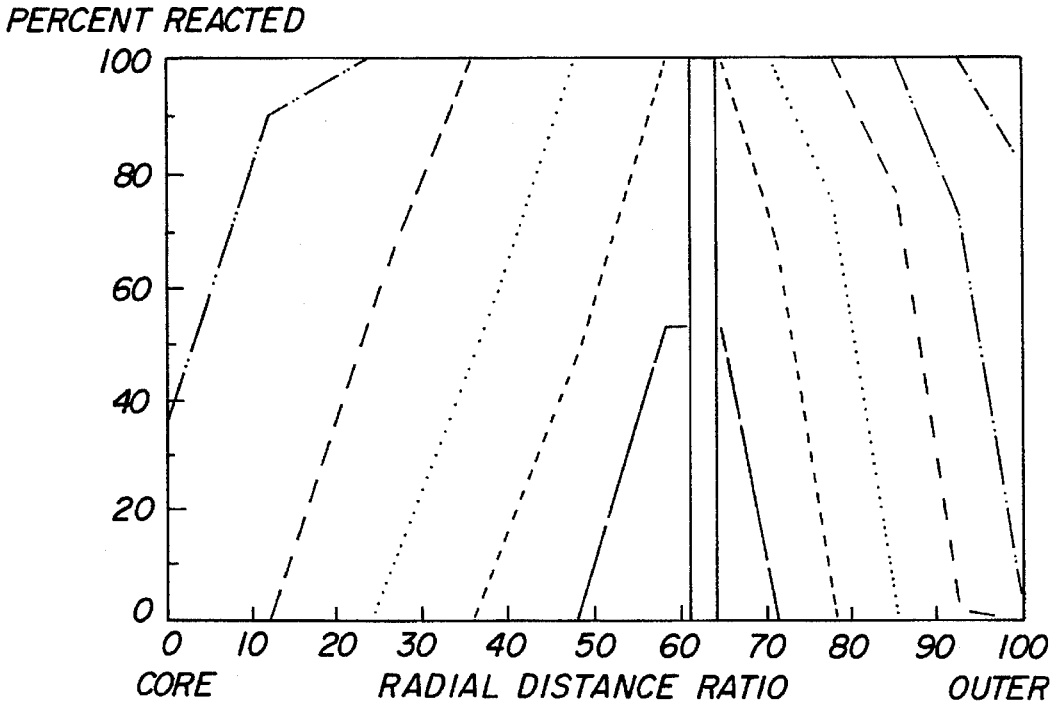
FIG. 5(*a*) is a charge profile illustrating the progression of the processing front with time.
Figure 5B:
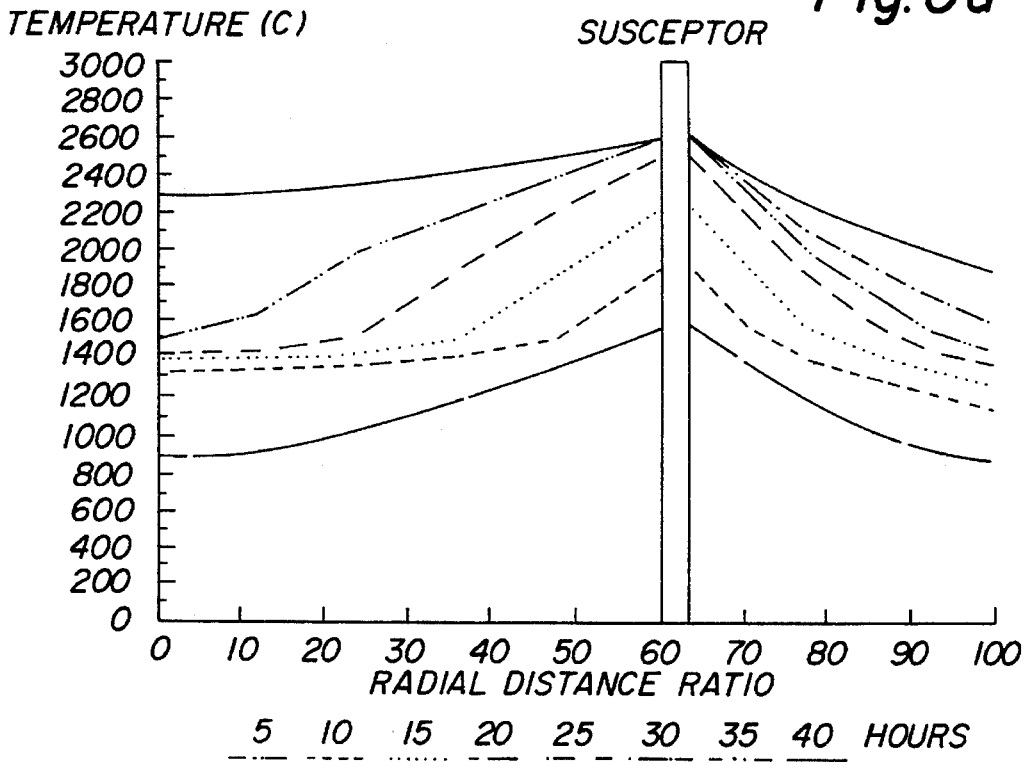
Figure 6:
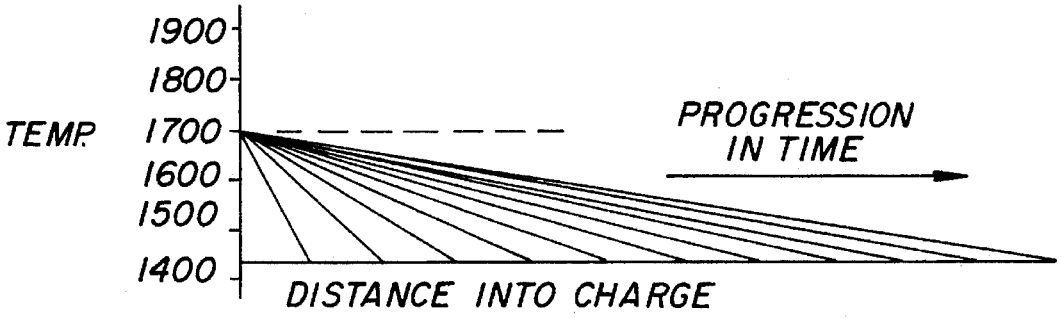

FIG. 5(*b*) is a temperature profile of FIG. 5(*a*) showing heat being driven to the charge of a ring heated furnace, FIG. 6 is a schematic temperature profile of an externally heated furnace of the prior art, FIG. 7 is a schematic view illustrating various configurations of reactors for the same maximum heat transfer dimension "a", FIG. 8 is a graph illustrating the scale-up benefits of the invention, FIG. 9 are graphs illustrating the effect of radial placement of susceptor on reactor performance.

Figure 10B:
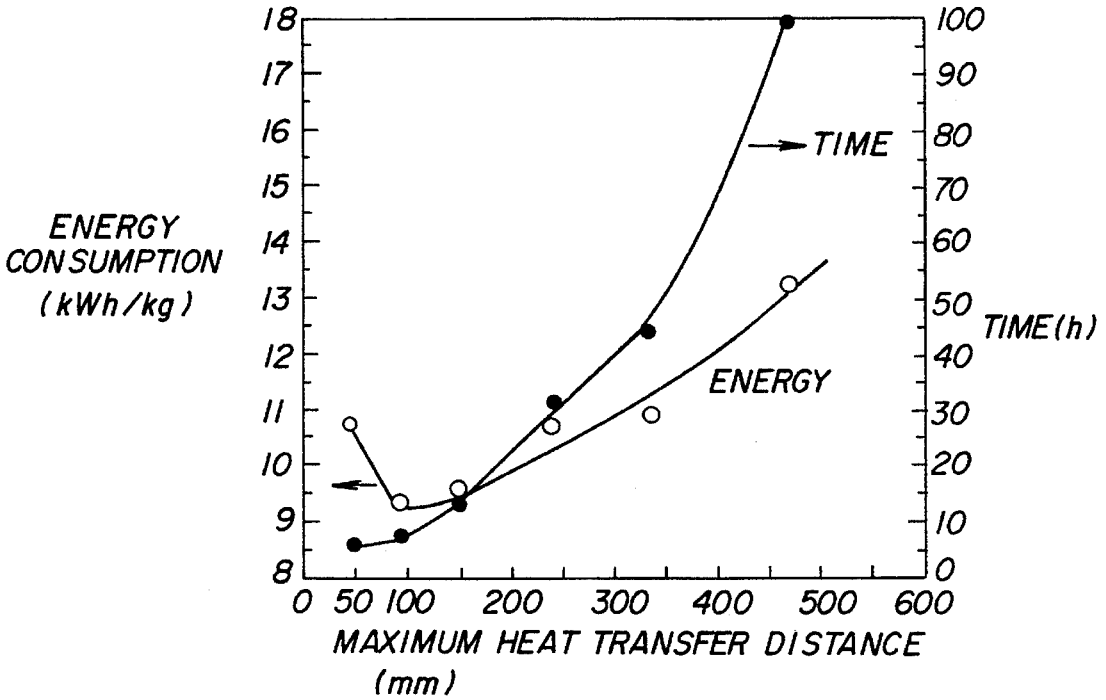
Figure 10A:
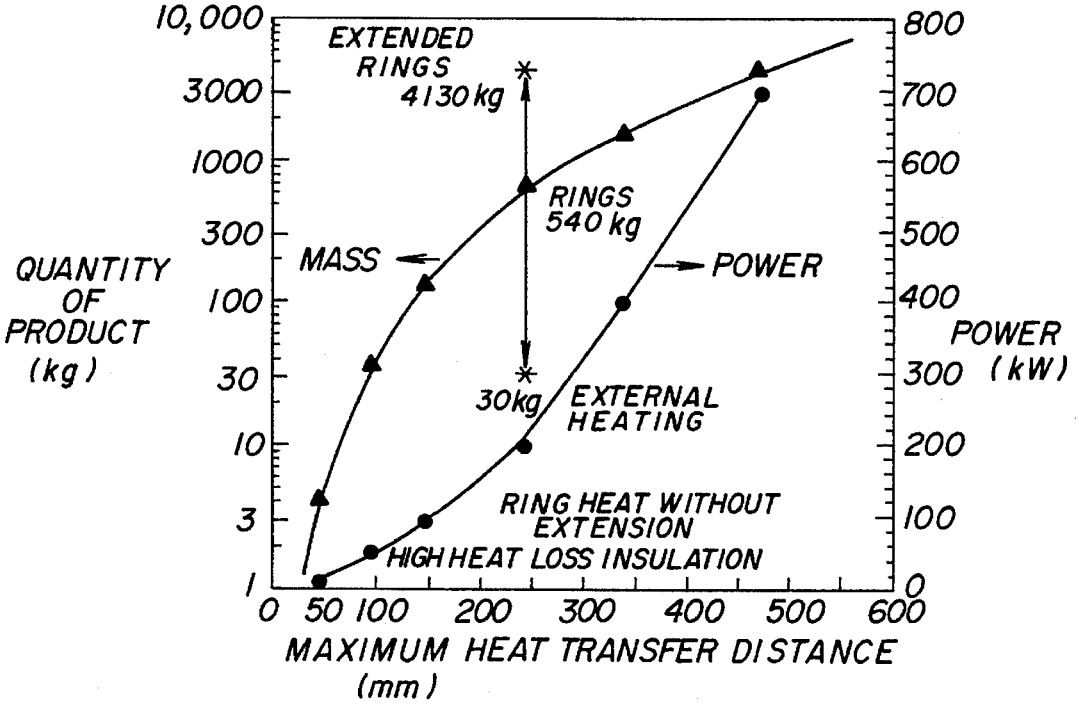
Figure 15A:
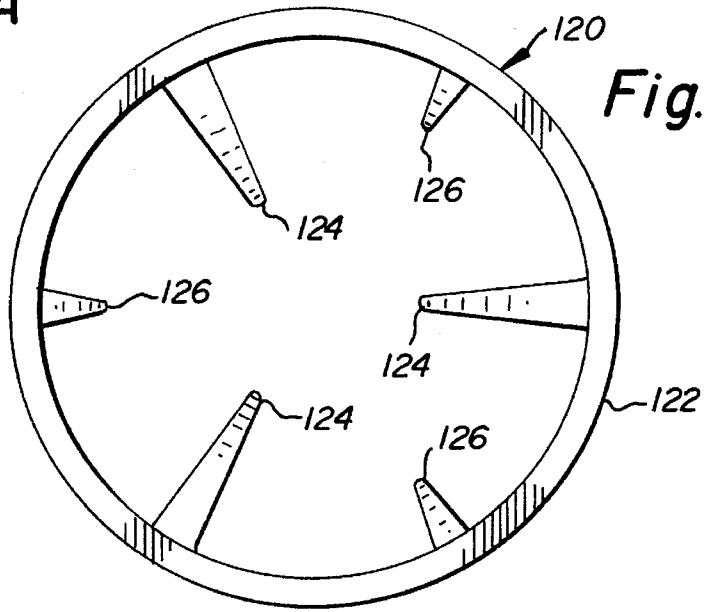
Figure 15B:
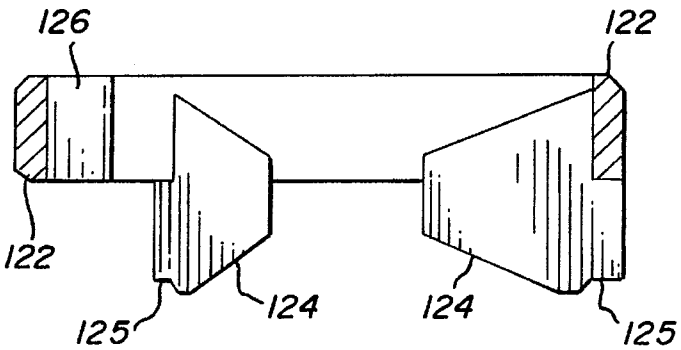

FIG. 10 are graphs illustrating the effect of maximum heat transfer distance on scale-up, FIG. 11 is a radial cross-section of alternative embodiments of the susceptor, FIGS. 12A to 15A show plan views of alternative susceptor designs, FIGS. 12B to 15B show side elevation views of cross-sections taken along the diameter of the susceptors shown in FIGS. 12A to 15A, and FIG. 16 shows a susceptor stack utilizing the susceptor design of FIGS. 15A and 15B.

DETAILED DESCRIPTION OF THE INVENTION

Figure 1:
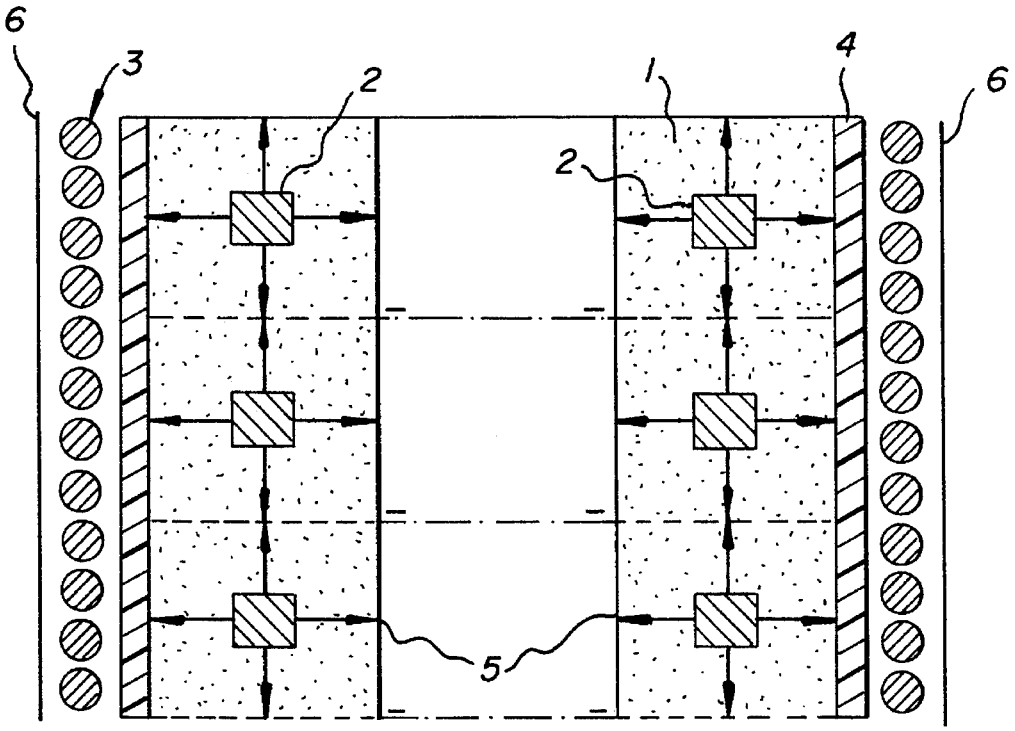
FIG. 1 is a schematic cross-sectional elevation of a furnace configuration in accordance with the invention where the charge is annular and the center is hollow.
Figure 2:
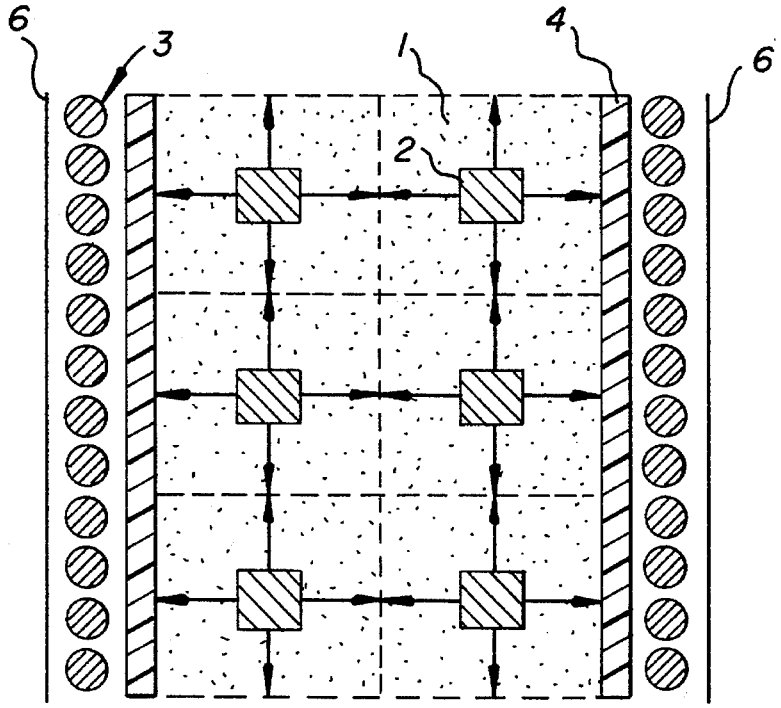
FIG. 2 is a similar cross-sectional elevation of a second embodiment of the furnace configuration with a solid cylinder of charge.

Referring to FIGS. 1 and 2, a furnace comprises a body of charge 1 within which are suspended one or more spaced graphite susceptor rings 2. When two or more susceptors are used, the susceptors are held in physical separation by supports (not shown) preferably of graphite. Thus as the reaction proceeds and the bulk density of the charge changes, the orientation of the susceptors in the furnace is maintained. The susceptors are heated by an electromagnetic induction coil 3 operating at a frequency of 50–100,000 Hz. The susceptors and the coil are generally co-axial. One or more insulation layers 4 separate the charge from water cooling coils (not shown), the electromagnetic induction coils and the outer shell 6. It will be appreciated that only part of the vertical extent of the furnace is shown in FIGS. 1 and 2. In practice, the top of the furnace will be closed with a lid. The lid may be considered to form part of the outer shell of the furnace and the outer shell allows the control of the gaseous atmosphere inside the furnace during operation. In processes which generate gaseous by-products the lid or outer shell may be provided with one or more outlets to enable the gaseous by-products to escape from the furnace.

For a solid charge as in FIG. 2 the susceptors are positioned so that the center of area of the radial cross-section is 30–90% of the distance from the centre to outer surface of the charge and preferably within the range of about 46–85% and most preferably 64–76%. The maximum heat transfer distance for the invention is therefore much less than the maximum heat transfer distance of 50% of the diameter for externally or core heated furnaces currently in use.

For an annular charge as in FIG. 1 the susceptors are positioned so that the center of area of a radial cross-section is 30–90% of the distance from the inner surface of the charge to the outer surface of the charge and preferably within the range of about 46–85% and most preferably 64–76%. The space 5 in the center of the annulus can be filled with insulating material or it can be left vacant to act as a chimney for gases produced in the reactor. The center of area of a radial cross-section of the susceptor is the area center of gravity of the radial cross-section.

To establish the optimum placement of the susceptor in the charge, a furnace of a required scale is run a number of times. From observations and measurements of the furnace product as it is removed from the furnace after each run, the extent of the progressing zone front is determined by chemical analysis or x-ray diffraction testing. FIG. 3 illustrates the progression of a progressing zone front through a charge. In the case of a chemical reaction, the progressing zone front is considered to be the point where the reaction is 98% complete or such extent of reaction as defines acceptable product grade.

The observations and measurements can be used to assess optimum total energy input to the furnace and in practice, the preferred endpoint is when a thin crust of incompletely reacted material is adjacent the external surfaces of the charge as the external surfaces of the charge represent the external heat loss surfaces. By leaving a thin crust, high yield of product is obtained with minimal damage to the refractories.

The uppermost and lowermost of the susceptors should also be positioned such that the progressing zone front reaches the upper extent and lower extend, respectively, of the charge upon completion of the reaction.

From these observations and measurements, the optimal placement of the susceptors in the charge is determined and the position of the processing front with time as shown in FIG. 3 can be calculated. The yield, energy consumption, processing time and susceptor temperature can also be determined. A control model can then be developed to determine a time profile of power input for maximum productivity within the processing limits of charge volatility, susceptor temperature and product sintering and fusion.

The reactor performance upon scale-up, in general terms, is strongly dependent on power input and total energy input. Power input is maximised within the limits of charge stability, boron loss, susceptor temperature, product sintering and avoidance of product fusion. That power limit may be expressed in terms of uniaxial heat flow from a single planar source, which generates a reaction zone which progresses through the charge as shown in FIGS. 5(*a*) and 5(*b*).

Placement of the susceptor affects the performance of the reactor and the product obtained from it. The placement should be such that the heat transfer conditions in the direction of heat flow from the susceptor should be similar for all parts of the charge. By placing the susceptor in this way it is possible for the optimum power input profile to be used. With less than optimum placement, the limitations placed on power input for some parts of the charge, apply to all parts of the charge.

If the susceptor is placed outside the range of radial position of the invention, then the processing zone reaches the insulation before reaction is complete within the bulk of the charge. Insulation damage results and heat losses are high if more energy is supplied to complete the processing. If the reaction is stopped earlier, then incompletely processed material within the charge degrades the product.

A similar situation exists if the susceptors are placed too far apart.

If the susceptor is placed too far in, then poor electromagnetic coupling may result. With the susceptor too far in, the susceptor temperature can rise to the point where the product is sintered or fused. At the same time a large unprocessed layer may be left on the outside of the product, which can represent a substantial loss in yield. At large scale it is possible that the processing zone will reach steady state, because the temperature is below that at which significant reaction occurs and yield will not increase, no matter how long the reaction time.

If the susceptors are placed too close to each other then they will run hotter. The main disadvantage is that more susceptors are required and the volume of charge is reduced.

The benefits of the invention will now be demonstrated with reference to a high temperature process which is heat transfer limited. Such a process is the carbothermic reduction of titanium dioxide to titanium diboride.

The reaction is carried out according to the following formula at temperatures above 1448° C. at atmospheric pressure.

$$TiO_2+B_2O_3+5C \rightarrow TiB_2+5CO(g)$$

The $B_2O_3$ has a melting point of 450° C. and a boiling point of 1860° C. so is highly volatile at process temperature. Both the product and the reactants have low thermal conductivity values and the chemical reaction is highly endothermic. Low thermal conductivity values are considered to be less than 20 W/m °C.

The effect of changing the radial placement of a cylindrical susceptor for a 300 kg reactor, 1.0 m diameter charge, 1.5 m high with 150 kW power input is shown in FIG. 9(*b*) and 9(*c*). The susceptor temperature is controlled to a maximum of 2600° C. while maintaining the temperature in advance of the processing zone front below the temperature constraint on the reactants which is about 1700° C.

With susceptor inside about 0.55 radius ratio, both the reaction time and energy consumption rise rapidly. Yield also drops because an outer layer of unreacted charge is left. The radius ratio at which this occurs is dependent on the amount of insulation used, and the conductivity of the charge and product. In a better insulated furnace the rise will be less steep, and the yield better.

With the susceptor outside the preferred radius ratio of about 0.7, the reaction time and energy consumption increase as heat losses through the insulation increase. The potential for damage to the insulation is greater as the energy input is increased to ensure complete reaction at the core.

A similar example is shown in FIG. 9(*a*) and 9(*b*), but in that case the power input is constant through to 95% reaction.

With a susceptor placed with a radius ratio of less than 0.6, fusion occurs at the susceptor. With the susceptor placed outside the 0.7 radius ratio, fusion also occurs around the susceptor. With the susceptor placed in the range 0.6 to 0.7 fusion does not occur. It should be noted that if power input is reduced, the range of positions, where fusion does not occur, increases. At lower power inputs, reaction times are longer and energy consumptions higher.

The optimum position for the susceptor placement is dependent on scale, heat losses, charge and product conductivities, arrangement in 3 dimensions, and power input in any particular application. It is considered that for all practical purposes, over a wide range of the above variables, the optimum position will lie in the range 0.3 to 0.9 times the distance from the center or inner limits of the charge.

The preferred range is 0.6 to 0.85 times the distance from the centre or inner limits of the charge to the outer limits of the charge. This is based on experience with L, E, F, and M series coils, and on model results such as is shown in FIGS. 11(*b*) and 11(*c*). In that example the heat losses are relatively high, and in a better insulated furnace the optimum would move closer to 0.85.

The gap between the coil and the susceptor is important in determining the Q factor of the coil and load.

A working formula is that $$KVAR/KW=1.4(GAP+0.5*PENETRATION\ DEPTHS)/0.5*PENETRATION\ DEPTHS$$

wherein $$Q= KVAR/KW= \text{reactive power per kW input}$$

GAP is distance from the coil to susceptor.

At 300 Hz, a 200 mm gap to a graphite susceptor will give a Q factor about 10. The choice of frequency, susceptor material, refractory and placement of the susceptor is crucial to the satisfactory operation of the furnace. Optimum placement which takes into account coupling requirements may place the susceptor further out than the optimum position based on heat transfer requirements alone.

In low thermal conductivity product or charge, the susceptor represents the path of least thermal resistance and so can be shaped so that it can conduct heat through the charge.

As would be appreciated by those skilled in the art it is desirable to provide as large a heat transfer area from the heat source as possible.

Therefore, it may be advantageous to shape the rings so that the cross-sectional configuration is elongated in the radial direction as shown in FIGS. 11(*b*), (*d*) and (*h*).

A portion of the susceptor must be capable of coupling with the induction coils. This coupling position can be part of the conducting portion of the susceptor as in FIG. 11(*b*) but to reduce the mass of susceptor in the furnace a configuration as in FIG. 11(*d*) and (*h*) is preferred. The susceptor is formed as a single article to maximise the heat transferred from the coupling portion to the conducting portion.

It is preferable that the total volume of susceptor material in the furnace is less than 20% of the total charge volume.

This limit is due to the additional thermal load of the susceptor on the process during both heating and cooling.

The susceptor also represents the path of least thermal resistance and so it can be shaped so that it can conduct heat through the charge. Therefore, it may be advantageous to shape the rings so that the cross-sectional configuration is elongated in the radial direction for example as in FIGS. 3(*b*) and 3(*c*).

The susceptors shown in FIGS. 11(*d*) and 11(*h*) and FIGS. 3(*b*) and 3(*c*) are formed as solids of revolution and as such the radially inwardly extending conducting portion extends around the susceptor. However, the conducting portion need not be continuous around the inner part of the susceptor. Alternative susceptor shapes are shown in FIGS. 12A to 15B.

Figure 12A:
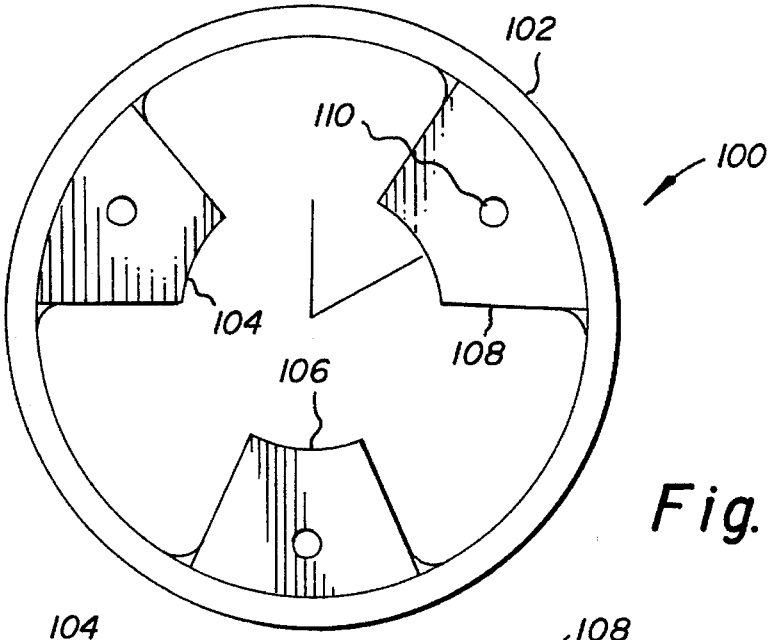

Referring to FIG. 12A, the susceptor 100 includes coupling portion 102 that provides a continuous current path for induced current. The conducting portion of susceptor 100 includes three inwardly extending portions 104, 106, 108. Holes 110 may be provided in inwardly extending portions 104, 106, 108 to reduce the mass of the susceptor and to facilitate charging of the furnace.

Figure 13A:
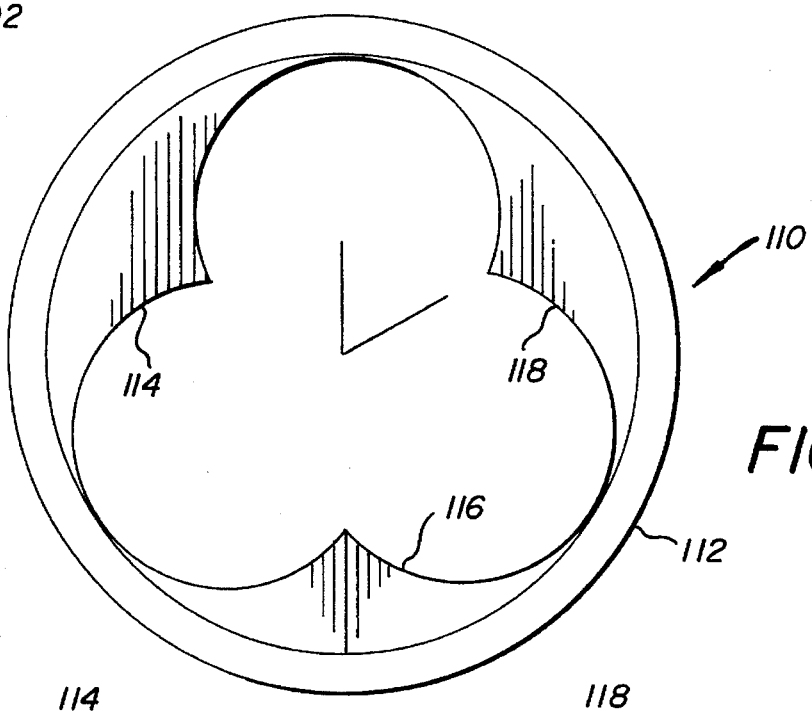

Susceptor 110 shown in FIG. 13A includes coupling portion 112 and inwardly extending portions 114, 116, 118, which act as the conducting portion of the susceptor.

Figure 12B:
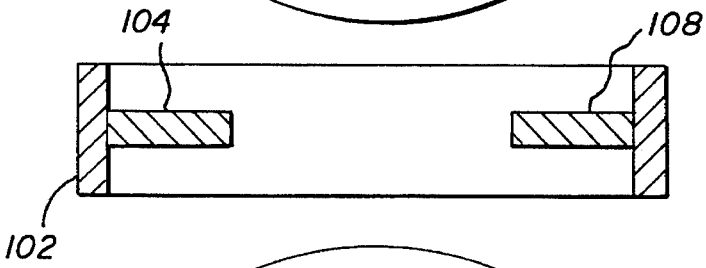
Figure 13B:
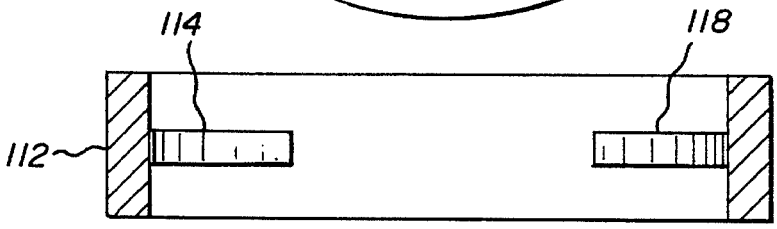

The conducting portions of the susceptors shown in FIGS. 12 and 13 are flat portions that extend inwardly from the midpoint of the height of the susceptors (as is clearly shown in FIGS. 12B and 13B). If these susceptors are used in a furnace having a number of susceptors arranged in a vertical stack, it is necessary to use spacing elements to maintain the susceptors in a spaced relationship. The spacing elements may be positioned on the coupling portion or on the conducting portions.

Figure 14A:
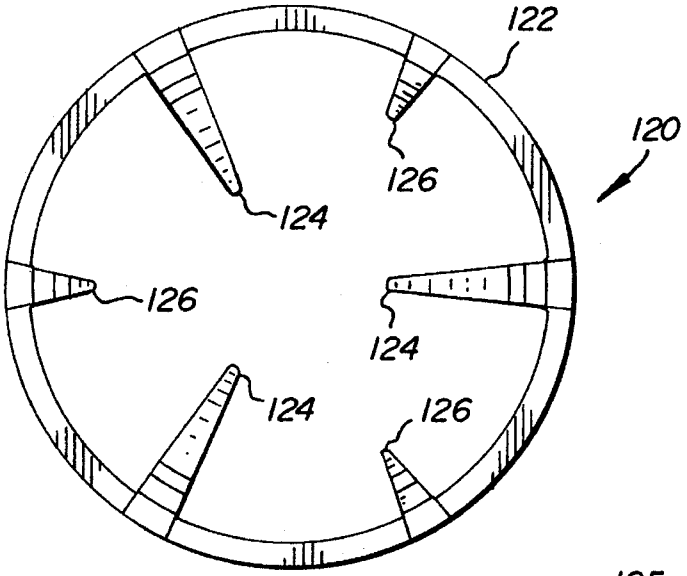
Figure 14B:
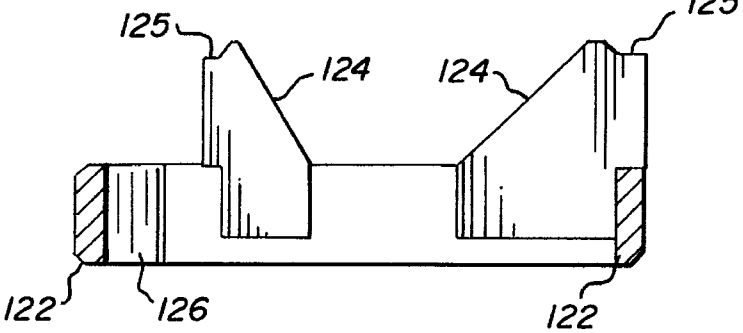

FIGS. 14A and 15A show further susceptor designs that include conducting portions that also act as spacing elements. As shown in FIG. 14A, susceptor 120 includes coupling portion 122. The conducting portion of susceptor 120 includes inwardly extending portions 124 and 126. Portions 124 extend inwardly to a much greater extent than portions 126. As shown in FIG. 14B, portions 124 extend upwardly above the top edge of coupling portion 122. This enables portions 124 to act as spacing elements for stacking of a number of susceptors 120 in the furnace. Portions 124 are provided with a flat surface 125 to facilitate stacking of susceptors.

Figure 16:
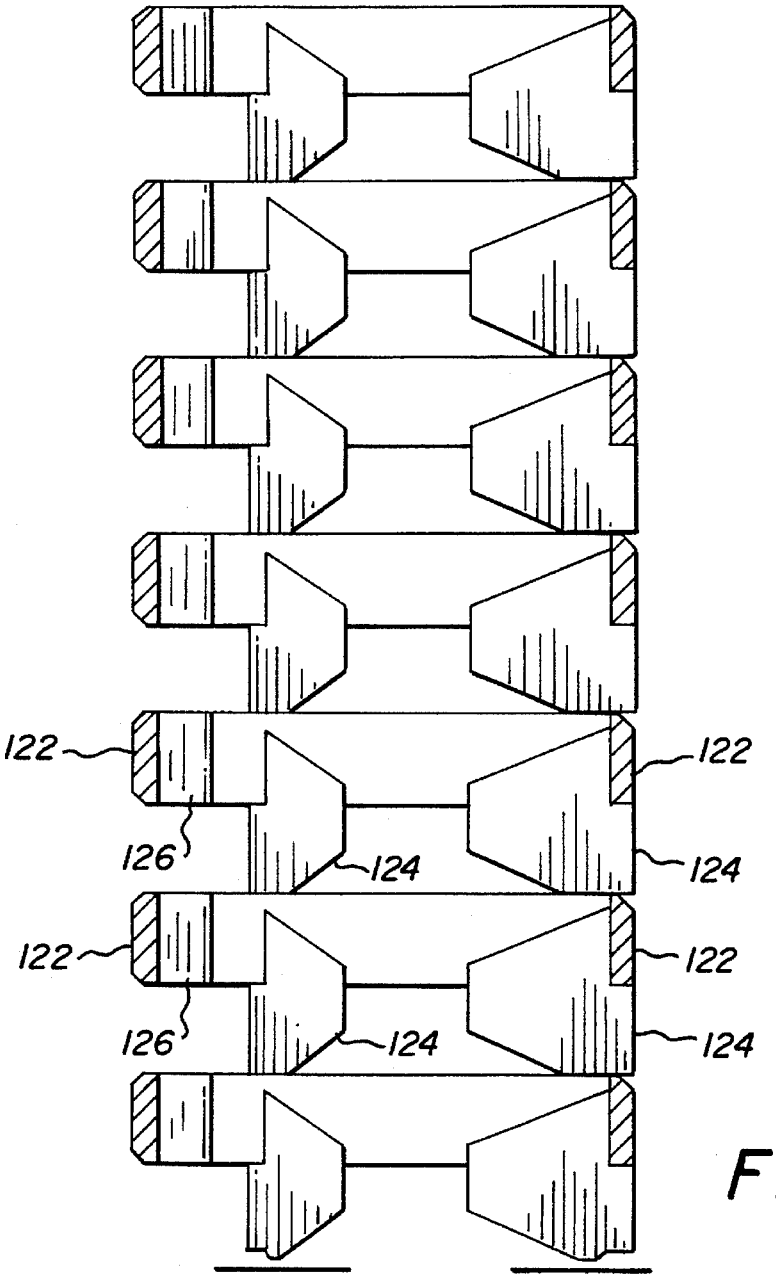
Figure 6:
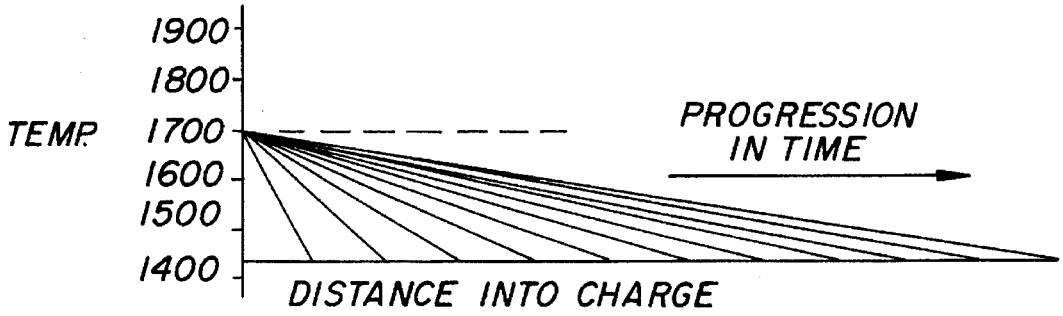
Figure 16:
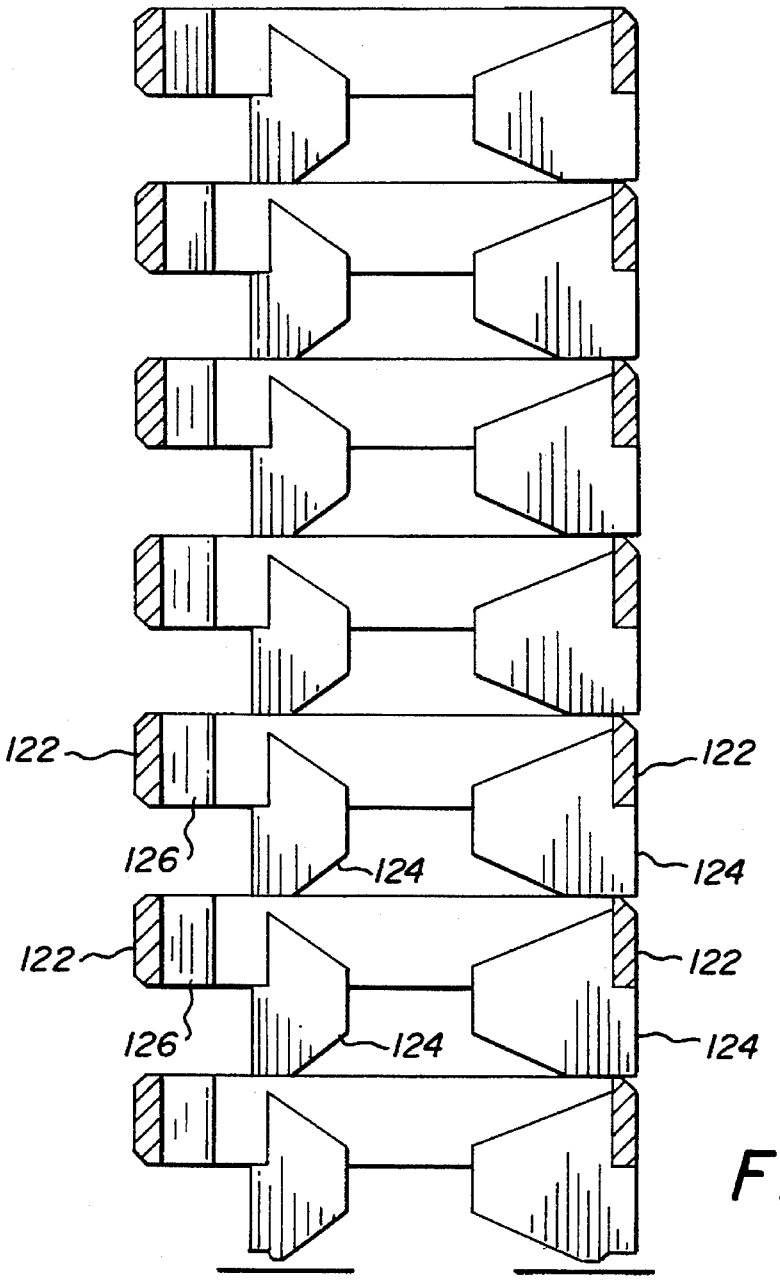
Figure 9A:
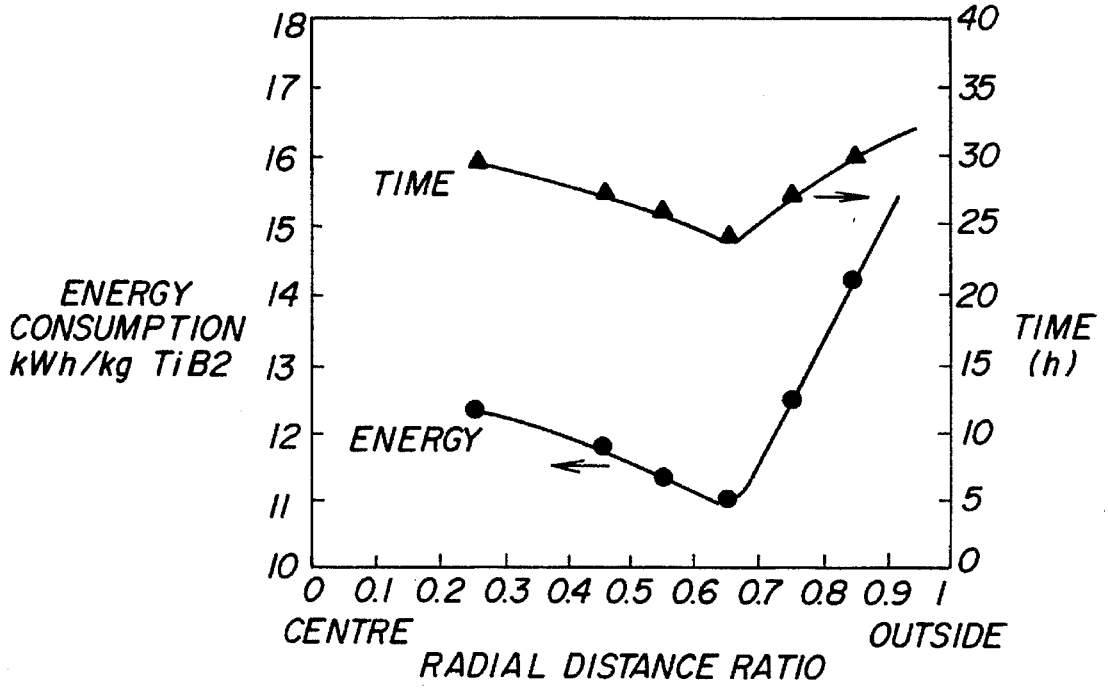
Figure 9B:
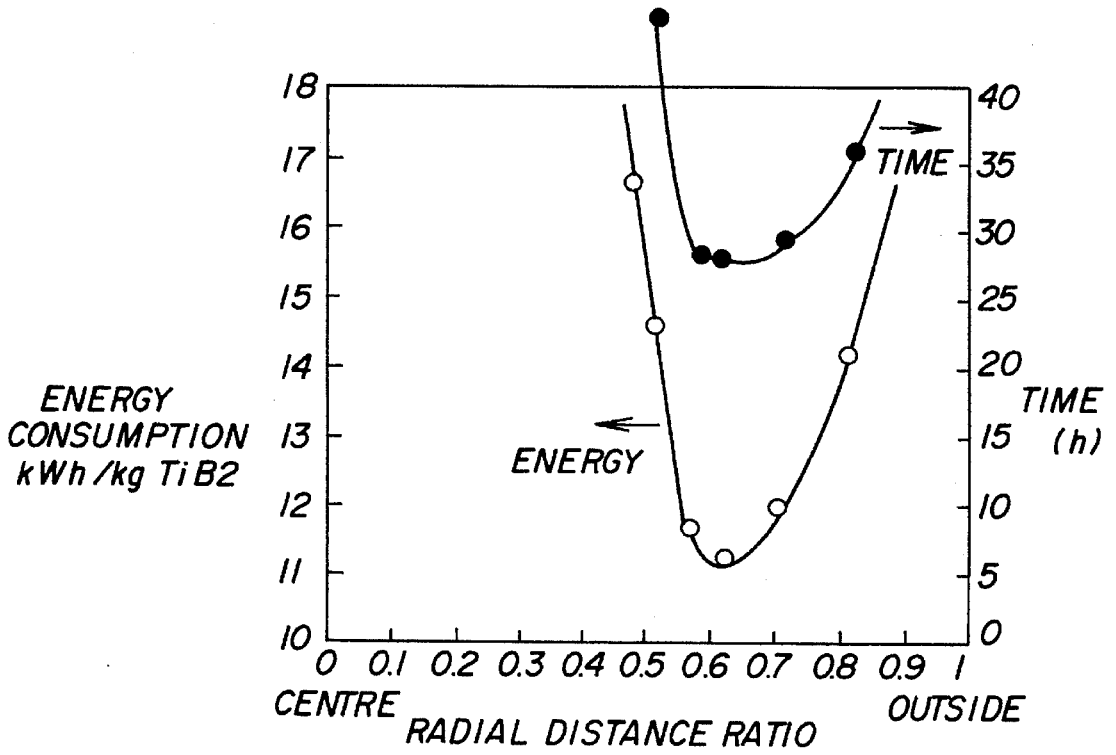
Figure 9C:
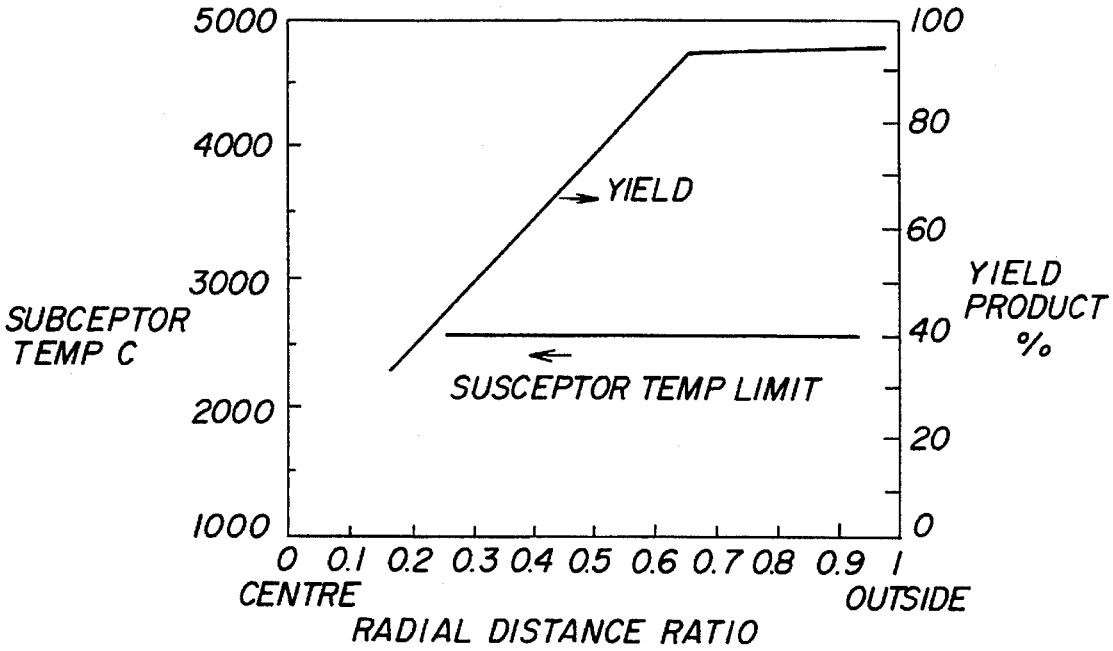
Figure 9D:
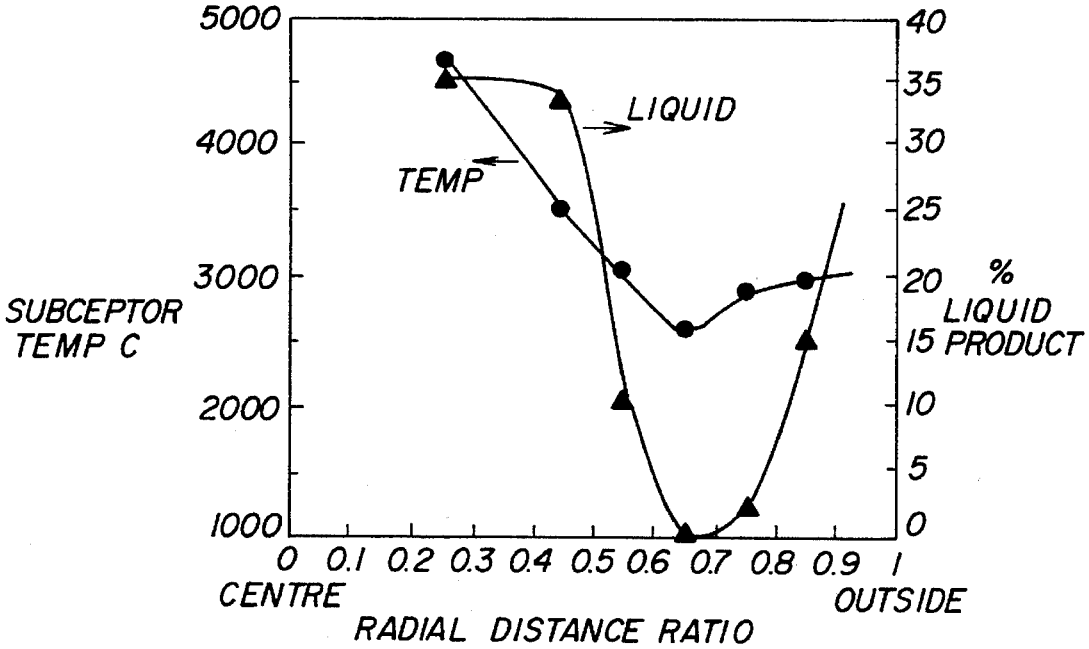

FIGS. 15A and 15B show a similar susceptor arrangement to that shown in FIGS. 14A and 14B, with the exception that portions 124 extend downwardly. An assembly of the susceptors of FIGS. 15A and 15B are shown in FIG. 16. This FIGURE clearly shows the simple stacking arrangement of the susceptors.

The use of susceptors having shapes as shown in FIGS. 12 to 15 result in a decrease in the mass of the susceptor when compared to susceptors having conducting portions that extend continuously around the inner periphery of the coupling portion. Further, the alternative susceptor shapes may result in easier packing of the furnace with the charge of reactants.

The susceptors may be produced by any convenient methods known to those skilled in the art. For simple susceptor shapes, machining may be the preferred method of manufacture. For more complex shapes, moulding may be used instead of machining. For example, if the susceptor is made from graphite, simple susceptor shapes may be machined from graphite rods. More complex shapes may be moulded from a carbon/pitch composite and subsequently baked to graphitize the structure. Other composite materials may also be used in a moulding process for manufacturing the susceptors.

The benefits of the invention are shown in FIG. 10 when scaling up the reactor.

For any furnace arrangement at a given scale, the maximum heat transfer distance can be determined. The time taken and the thermal gradient required to progress a processing zone through to that distance is dependent on the thermal conductivity of the charge and product the heat loss from the furnace and the allowable power input. Any scale-up involves a substantial increase in the maximum heat transfer distance unless it is performed in accordance with the invention.

The graph shows that for a ring heated furnace with the susceptors positioned in the optimum position the scale of the reactor increases as the maximum heat transfer distance increases.

A comparison between an externally heated furnace, a ring heated furnace and an extended ring furnace for the production of titanium diboride with a maximum heat transfer distance of 250 mm shows that the maximum furnace capacity is 30 kg, 540 kg and 4136 kg. Thus the enormous benefits of a ring heated furnace in accordance with the invention and the benefits of the extended ring are clearly demonstrated.

The benefits of the invention are further illustrated in FIGS. 6, 7 and 8 by comparing the size of the furnace which are possible for a given maximum heat transfer distance.

The furnaces shown in FIG. 7 all have the same maximum heat transfer distance and from left to right represent a solid and annular externally heated furnace, a solid and annular ring heated furnace and an annular extended ring heated furnace.

As shown in FIG. 8, the variation in configuration from a solid charge externally heated furnace to an extended ring heated furnace represents an increase in scale of over 100 times for the same maximum heat transfer distance.

As the susceptor is placed within the charge, the power input from the susceptor can be controlled to drive the temperature within the physical limits of charge and susceptor and the later stages of the processing on the physical limits of the insulation.

FIG. 6 illustrates the temperature profile of an externally heated reactor constrained by the thermal limit of the insulation (1700° C.). The power to the furnace actually has to be decreased with time to remain within the constraints.

FIG. 5(*b*) is a temperature profile further demonstrating the benefits of the invention. The susceptor is heated up to the thermal constraints of the charge (1700° C.) until the processing zone front moves from the susceptor surface. At this time the reaction at the susceptor surface is at least 98% complete. FIG. 5(*a*) shows how the processing front progresses through the charge when a temperature profile such as shown in FIG. 5(*b*) is employed.

Figure 4A:
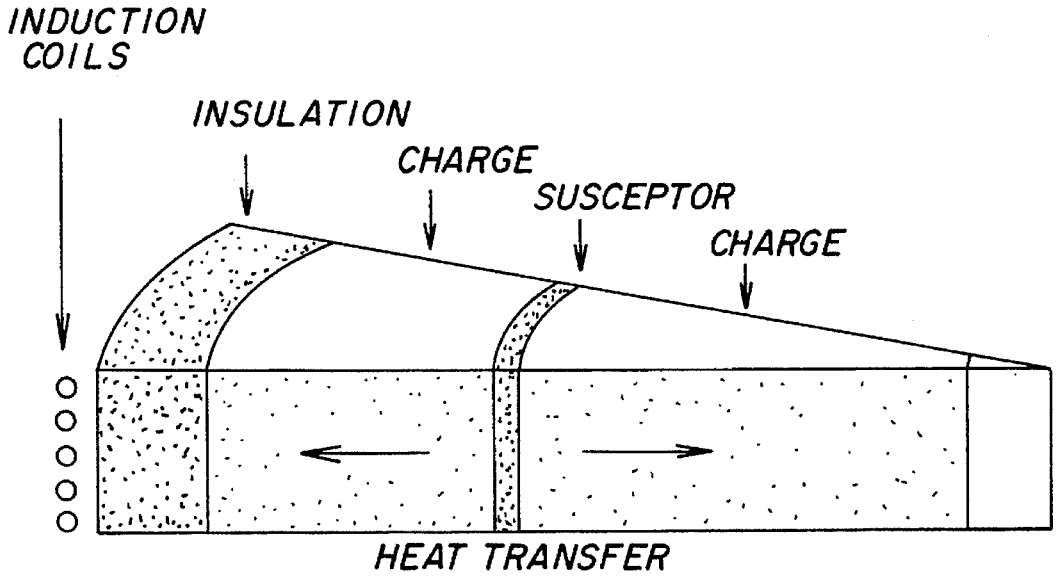
FIG. 4 are further schematic views illustrating the progression of the processing zone through the charge.
Figure 4B:
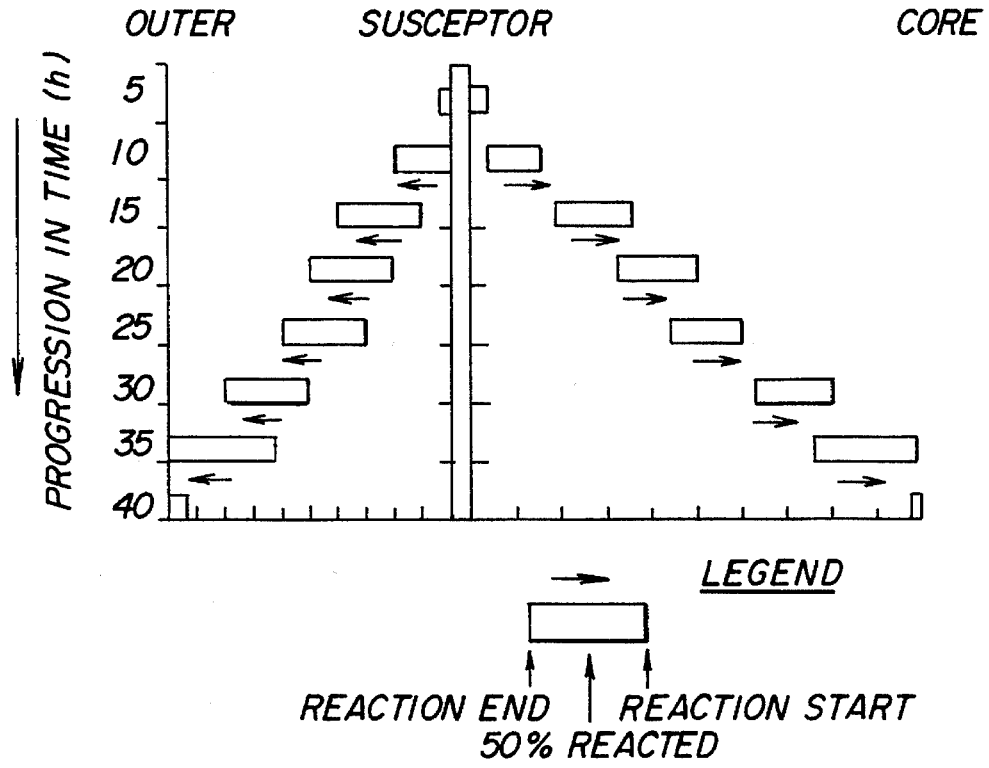

As the processing front progresses through the charge as shown in FIG. 4, the temperature of the susceptor is increased so that the temperature of the charge in advance of the front is below the thermal constraints of the charge.

The temperature of the susceptor can thus be taken up to the temperature limit of a graphite susceptor (about 2600° C.), allowing heat to be driven to the charge resulting in faster processing times and higher yield. The processing is stopped when the processing front reaches the outer surfaces of the charge to minimise insulation damage.

The ring heating shown in FIG. *5a* to *5b* is conducted at constant power input enabling greater ease of control.

Although the invention has been described in respect of one specific $TiB_2$ reaction route, other $TiB_2$ production process which are strongly endothermic and which rely on the reduction of oxides either by carbon or mixtures of carbon with Mg, Al, B or Ti may be equally improved by the use of this reactor.

Other high temperature reactions which are highly endothermic such as silicon smelting and ferroalloy production may also derive benefit from being carried out in the furnace configuration of the invention.

The invention is also suitable for the production of other ceramic materials such as silicon carbide, boroncarbide, titanium carbide and various other carbides, borides and nitrides.

We claim:

1. A method for the preparation of a product by heating a charge of reactants to a high temperature wherein said reactants undergo a reaction to form said product, at least one of said reactants and said product having a low thermal conductivity, said reaction having a high heat of reaction, which method comprises —providing a furnace configuration comprising an outer shell which enables control of gaseous atmosphere inside the furnace during operation, an induction means adjacent said outer shell, a thermal insulating layer insulating said induction means, a charge receiving space within said insulating layer for receiving said charge, said charge being placed in the charge receiving space such that the charge occupies a volume defined between an inner limit of the charge and an outer limit of the charge, said inner limit of the charge being defined as a part of the charge which is farthest from said insulating layer, induction susceptor means positioned within said charge receiving space, said induction susceptor means having a coupling portion that provides a continuous conductive path for induced current within said susceptor means, — energizing said induction means to thereby heat said susceptor means and to cause the charge located adjacent said susceptor means to increase in temperature and to undergo said reaction of said charge to produce said product and to form a progressing zone front for substantially completely-reacted charge, wherein said progressing zone front emanates away from said susceptor means as time elapses, —wherein said susceptor means is positioned within said charge in said charge receiving space such that a cross-sectional center of area of said susceptor means in a radial direction is within about 30–90% of a radial distance from the inner limit of the charge to the outer limit of the charge and the charge of reactants located between the inner limit of the charge and an inner part of said susceptor means has substantially reacted when the progressing zone front reaches said outer limit of the charge.

2. A method in accordance with claim 1 wherein the susceptor means is at least one substantially hollow cylinder.

3. A method in accordance with claim 1 wherein said susceptor means comprises at least two susceptors positioned in the charge such that when said induction means is energized a progressing zone front for substantially completely-reacted charge emanates away from each of said at least two susceptors and a progressing zone front emanating away from a susceptor reaches the inner limit of the charge or a progressing zone front emanating away from an adjacent susceptor prior to reaching the outer limit of the charge.

4. A method in accordance with claim 3 wherein the at least two susceptors are stacked in a vertical arrangement with spacing means located between adjacent susceptors to maintain said adjacent susceptors in spaced relationship.

5. A method in accordance with claim 4 wherein said spacing means are formed as part of said susceptors.

6. A method in accordance with claim 1 wherein gas generated during said reaction escapes from said furnace via a gas exit means.

7. A method in accordance with claim 6 wherein said charge is placed in said charge receiving space such that at least one elongate space is present in said charge and the at least one elongate space acts as a chimney along which said gas escapes.

8. A method in accordance with claim 7 wherein said elongate space is located around a central axis of said furnace.

9. A method in accordance with claim 3 wherein the at least two susceptors are substantially annular.

10. A method in accordance with claim 1 or claim 3 wherein said susceptor means comprises an inductive coupling portion and a conducting portion extending radially from said coupling portion to conduct heat generated in said coupling portion into the charge.

11. A method in accordance with claim 10 wherein the conducting portion of said susceptor means has a higher thermal conductivity than the charge or product.

12. A method in accordance with claim 1 wherein the product is a refractory hard material.

13. A method in accordance with claim 12 wherein said refractory hard material is titanium diboride and said charge of reactants includes $TiO_2$, a source of boron and a source of carbon.

14. A method in accordance with claim 1 wherein said method is operated in a batch-wise manner.

15. A method of controlling a furnace configuration having an outer shell, an electromagnetic induction means adjacent said shell, an insulating layer insulating said induction means, a charge receiving space within the insulation layer, a charge positioned in said charge receiving space, whereby the charge occupies a volume defined between an inner limit of the charge and an outer limit of the charge, said inner limit of the charge being defined as a part of the charge which is farthest from said insulating layer, and an induction susceptor means, said induction susceptor means being positioned within said charge such that a cross-sectional center of area of the susceptor means in a radial direction is within the range of about 30 to 90% of a radial distance from the inner limit of the charge to the outer limit of the charge, said method comprising the steps of (i) heating said susceptor means up to a predetermined temperature, (ii) increasing a temperature of the susceptor means after a progressing zone front for completely reacted charge has progressed away from a surface of said susceptor means such that the charge which has not yet substantially completely reacted is of a temperature which remains below said predetermined temperature, and (iii) continuing to increase the temperature of the susceptor means while maintaining the temperature in advance of the progressing zone front below said predetermined temperature until a maximum temperature of the susceptor means is reached or the progressing zone front reaches the outer limit of the charge.

16. The method in accordance with claim 15 wherein the susceptor means is positioned such that the progressing zone front reaches the inner limit of the charge prior to reaching the outer limit of the charge.

17. The method in accordance with either of claims 15 or 16 wherein the cross-sectional center of area of the susceptor means in a radial direction is within the range of about 60–85% of the radial distance from the inner limit of the charge to the outer limit of the charge.

18. A high temperature furnace configuration for use in preparing products by heating a charge of reactants to a high temperature wherein said reactants undergo a reaction to form said products, at least one of said charge and said products having a low thermal conductivity, said reaction having a high heat of reaction, said furnace configuration comprising;

an outer shell which enables control of gaseous atmosphere inside the furnace during operation, an induction means adjacent said outer shell, a thermal insulating layer insulating said induction means, a charge receiving space within the insulating layer for receiving said charge, said charge being placed in the charge receiving space such that the charge occupies a volume defined between an inner limit of the charge and an outer limit of the charge, said inner limit of the charge being defined as a part of the charge which is farthest from said insulating layer, induction susceptor means positioned within said charge receiving space, said induction susceptor means having a coupling portion that provides a continuous conductive path for induced current within said susceptor means, said induction susceptor means being positioned within said charge in said charge receiving space such that a cross-sectional center of area of the susceptor means in a radial direction is within the range of about 30%–90% of a radial distance from the inner limit of said charge to the outer limit of the charge, wherein a progressing zone front for substantially completely reacted charge emanates away from the induction susceptor means and the charge located in a volume of the charge receiving space defined between the inner limit of the charge and an inner part of the induction susceptor means has substantially reacted when the progressing zone front reaches an external limit of the charge.

19. The furnace configuration in accordance with claim 18 in which the progressing zone front reaches the inner limit of the charge prior to reaching the outer limit of the charge.

20. The furnace configuration in accordance with claim 18, wherein the susceptor means is at least on substantially hollow cylindrical susceptor.

21. The furnace configuration in accordance with claim 18, wherein said susceptor means comprises at least two susceptors, each of said at least two susceptors having a progressing zone front for substantially completely reacted charge emanating away therefrom, the at least two susceptors positioned in the charge such that a progressing zone front emanating away from a susceptor reaches the inner limit of the charge or a progressing zone from emanating away from an adjacent susceptor prior to reaching the outer limit of the charge.

22. The furnace configuration in accordance with claim 18, 19 or 21, wherein said cross-sectional center axis of area of said susceptor means is positioned within the range of about 60– 85% of the radial distance from the inner limit of the charge to the outer limit of the charge.

23. The furnace configuration in accordance with claim 21, wherein the at least two susceptors are substantially annular.

24. The furnace configuration in accordance with claim 18 or 21, wherein said susceptor means comprises an inductive coupling portion and a conducting portion extending radially from said coupling portion to conduct heat generated in said coupling portion into the charge.

25. The furnace configuration in accordance with claim 24, wherein the conducting portion of said susceptor means has a higher thermal conductivity than the charge or product.

26. The furnace configuration in accordance with claim 24, wherein the conducting portion extends radially inwardly from said coupling portion.

27. The furnace configuration in accordance with claim 18, wherein the configuration is used for the production of transition metal borides.

28. The furnace configuration in accordance with claim 18, wherein the charge receiving space is annular shaped.

29. The furnace configuration in accordance with claim 18, further comprising a gas exit means to allow gases produced during operation of said furnace configuration to escape from said furnace configuration.

30. A high temperature furnace configuration having an outer shell which enables control of gaseous atmosphere inside the furnace during operation, an induction means adjacent said outer shell, an insulating layer insulating said induction means from said outer shell, a charge receiving space within the insulating layer for receiving a charge and an induction susceptor means positioned within said charge receiving space, the susceptor means comprising a coupling portion for inductively coupling to said induction means and a conducting portion extending radially from said coupling portion to conduct heat generated in said coupling portion into a charge within the charge receiving space, said coupling portion and said conducting portion being made of the same material.

31. The high temperature furnace configuration in accordance with claim 30, wherein the susceptor means comprises at least one substantially annular susceptor.

32. The high temperature furnace configuration in accordance with claim 30 or claim 31, wherein the coupling portion extends sufficiently in an axial direction of the furnace configuration to allow inductive coupling with said induction means.

33. The high temperature furnace configuration in accordance with claim 30 or claim 31, wherein the conducting portion of said susceptor means has a higher thermal conductivity than the charge or product.

34. A high temperature furnace configuration having an outer shell which enables control of gaseous atmosphere inside the furnace during operation, an induction means adjacent said outer shell, an insulating layer insulating said induction means from said outer shell, a charge receiving space within the insulating layer for receiving a charge and an induction susceptor means positioned within said charge receiving space, the susceptor means comprising a coupling portion for inductively coupling to said induction means and a conducting portion extending radially from said coupling portion to conduct heat generated in said coupling portion into a charge within the charge receiving space, wherein said conducting portion extends radially inwardly from said coupling portion.

35. A high temperature furnace configuration having an outer shell which enables control of gaseous atmosphere inside the furnace during operation, an induction means adjacent said outer shell, an insulating layer insulating said induction means from said outer shell, a charge receiving space within the insulating layer for receiving a charge and an induction susceptor means positioned within said charge receiving space, the susceptor means comprising a coupling portion for inductively coupling to said induction means and a conducting portion extending radially from said coupling portion to conduct heat generated in said coupling portion into a charge within the charge receiving space, wherein the conducting portion and coupling portion of the susceptor means are formed as a single component.

36. The high temperature furnace configuration in accordance with claim 30, wherein said susceptor means occupies a total volume of less than 20% of a total volume of the charge.

37. The method in accordance with claim 15, wherein the temperature of the susceptor means is altered by altering power input to said induction means.

38. A method in accordance with claim 1, wherein said method is operated in substantially continuous manner.

* * * * *